United States Patent [19]

Somers et al.

[11] Patent Number: 4,467,572

[45] Date of Patent: Aug. 28, 1984

[54] COLLAPSIBLE DWELLING FOR CHILDREN OR ANIMALS

[76] Inventors: Rex E. Somers, 816 W. Washington Blvd., Fort Wayne, Ind. 46804; Ray A. Beasey, R.R. #6, Huntington, Ind. 46750; Richard E. Woods, P.O. Box 393, Markle, Ind. 46770

[21] Appl. No.: 365,171

[22] Filed: Apr. 5, 1982

[51] Int. Cl.[3] ..... E04B 7/16

[52] U.S. Cl. ..... 52/70; 16/225; 16/DIG. 13; 52/66; 52/94; 52/143; 206/321

[58] Field of Search ..... 52/66, 69, 70, 71, 143, 52/95, 96, 90, 169.11; 206/321, 325, 284; 16/DIG. 13, 225; 217/14, 46; 110/19

[56] References Cited

U.S. PATENT DOCUMENTS

| | | | |
|---|---|---|---|
| 414,976 | 11/1889 | Harvey . | |
| 1,237,624 | 8/1917 | Eickhof . | |
| 1,407,462 | 2/1922 | Fasson | 52/71 |
| 1,558,545 | 10/1925 | Hoyle . | |
| 2,258,344 | 10/1941 | Walker . | |
| 2,445,055 | 7/1948 | Capaul . | |
| 2,680,327 | 6/1954 | Harper | 52/90 |
| 2,751,635 | 6/1956 | Donnahue . | |
| 2,829,081 | 4/1958 | Sweem | 16/225 |
| 2,835,931 | 5/1958 | Sterkin | 52/70 |
| 2,954,007 | 9/1960 | Mitchell . | |
| 2,963,122 | 12/1960 | Jagemann | 52/70 |
| 3,160,987 | 12/1964 | Pinkley | 52/95 |
| 3,280,796 | 10/1966 | Hatcher . | |
| 3,324,831 | 6/1967 | Onge | 52/71 |
| 3,445,052 | 5/1969 | Lewallen | 16/DIG. 13 |
| 3,458,242 | 7/1969 | Williams | 16/225 |
| 3,807,104 | 4/1974 | Webster | 52/70 |
| 3,835,600 | 9/1974 | Padula et al. | 52/69 |
| 3,866,577 | 2/1975 | Mathis . | |
| 3,866,745 | 2/1975 | Dlugopolski | 206/321 |
| 4,032,009 | 6/1977 | Taylor | 206/321 |
| 4,079,553 | 5/1978 | Kirk, Jr. | 52/71 |
| 4,109,427 | 8/1978 | O'Brian et al. | 52/70 |
| 4,237,914 | 12/1980 | Gantz | 52/71 |
| 4,296,524 | 10/1981 | Horholt et al. | 16/DIG. 13 |

FOREIGN PATENT DOCUMENTS

| | | | |
|---|---|---|---|
| 1382678 | 11/1964 | France | 16/225 |
| 4380 | 6/1895 | Norway | 52/70 |
| 1033233 | 6/1966 | United Kingdom | 16/DIG. 13 |

*Primary Examiner*—Henry E. Raduazo

*Attorney, Agent, or Firm*—Wood, Dalton, Phillips, Mason & Rowe

[57] ABSTRACT

A collapsible dwelling is provided, including a plurality of elements hingedly joined with each other, which, when in assembled relationship, cooperatively define a protective enclosure suitable for pets, or, when constructed on a larger scale, for young children. All elements are hinged strategically so that the elements can be partially disassembled and the aggregate parts stacked, one upon the other, for inclusion within a container having a length and width no greater than that of the largest elements. At least two anchoring loops are attached at opposing sides of the dwelling and are so situated that ground stakes capturing the loops can be driven into the supporting surface to positively locate the dwelling. The dwelling is designed to be packaged within a rectangular container with one of the anchoring loops coinciding with a cutout in the container, which loop, when drawn through the cutout, serves conveniently as a carrying handle.

10 Claims, 10 Drawing Figures

COLLAPSIBLE DWELLING FOR CHILDREN OR ANIMALS

BACKGROUND OF THE INVENTION

The feasibility of providing shelters for animals or collapsible playhouses for children has been severely restricted by numerous factors. From the standpoint of the consumer, the design and construction of such a dwelling can be both complicated and expensive. Alternatively, the purchase of a prefabricated kit may be costly, and depending upon its size, transportation of the kit, as by automobile or the like, might be impractical. Further, assembly of kits may be complicated and time-consuming, making such an investment undesirable.

From the standpoint of the supplier, such dwellings are impractical to stock in an assembled state because of the amount of space that they occupy. Even in a collapsed condition, the dwelling might be so large as to complicate storage. For example, the prefabricated shelter disclosed in Donnahue (U.S. Pat. No. 2,751,635), even when knocked down, occupies a large area, though it is of a minimal thickness.

Further, the shelter in Donnahue would require an expansive container which would be bulky and undesirably burdensome.

SUMMARY OF THE INVENTION

The collapsible dwelling of the present invention comprises first and second foldable wall elements, each including an endwall and sidewall, pivotally joined with each other for rotation about a substantially vertial axis. The wall elements are mated with each other to define a continuous wall structure, which supports and is secured with a roof element. Anchoring loops are attached to the walls, preferably on opposing sides, and when secured to a supporting surface, fixedly locate the dwelling.

It is the principal object of the invention to provide a collapsible dwelling that can be easily assembled and disassembled, compactly stored and easily transported.

In a preferred form, the invention contemplates that all connections between the endwalls, sidewalls and roof can be accomplished by mating hinge portions on the elements, that align and can be connected when the elements are properly matched. Thus, assembly requires no special tools.

To disassemble and store the dwelling, the first and second wall elements are detached, each from the other and the roof, and are arranged in stacked relationship. The entire assembly can then be inserted within a rectangular container having a length and width no greater than that of the largest and widest element. At least one of the anchoring loops is located so as to coincide with a cutout on one edge of the container, and when drawn through the cutout, functions conveniently as a carrying handle.

To accommodate irregularities in the supporting surface, a base is secured to the underside of the walls. A plurality of resilient blocks are disposed between the base and supporting surface. A pair of ground stakes can be used to capture the loops and when driven into the ground, positively locate the dwelling. The blocks also isolate the dwelling from any moisture contained by the supporting surface.

In one embodiment of the invention, a ventilating region is provided between the top of the sidewalls and the underside of the roof. To accomplish this, a gable is provided having edges extending laterally beyond the width of the endwalls, which are in height substantially the same as the sidewalls. With the roof mounted, the overhanging gable suspends the roof above the sidewalls forming a longitudinal air space on each side of the dwelling which permits cross-ventilation through the dwelling.

In one form of the invention, the roof is formed by a plurality of hinged panels, which may be covered by a flexible weatherproof material. Alternatively, the roof panels can be joined by flexible resilient members that serve also to deflect rain or the like from the connection between adjacent panels.

As an alternative to the above arrangement, the corners at the juncture of the end and sidewalls may be maintained by any of a number of resilient snap-fit corner joints.

While the foregoing discusssion refers specifically to a pet dwelling, on a larger scale the enclosure is also suitable as a playhouse for young children.

DETAILED DESCRIPTION OF THE DRAWINGS

Figure 1:
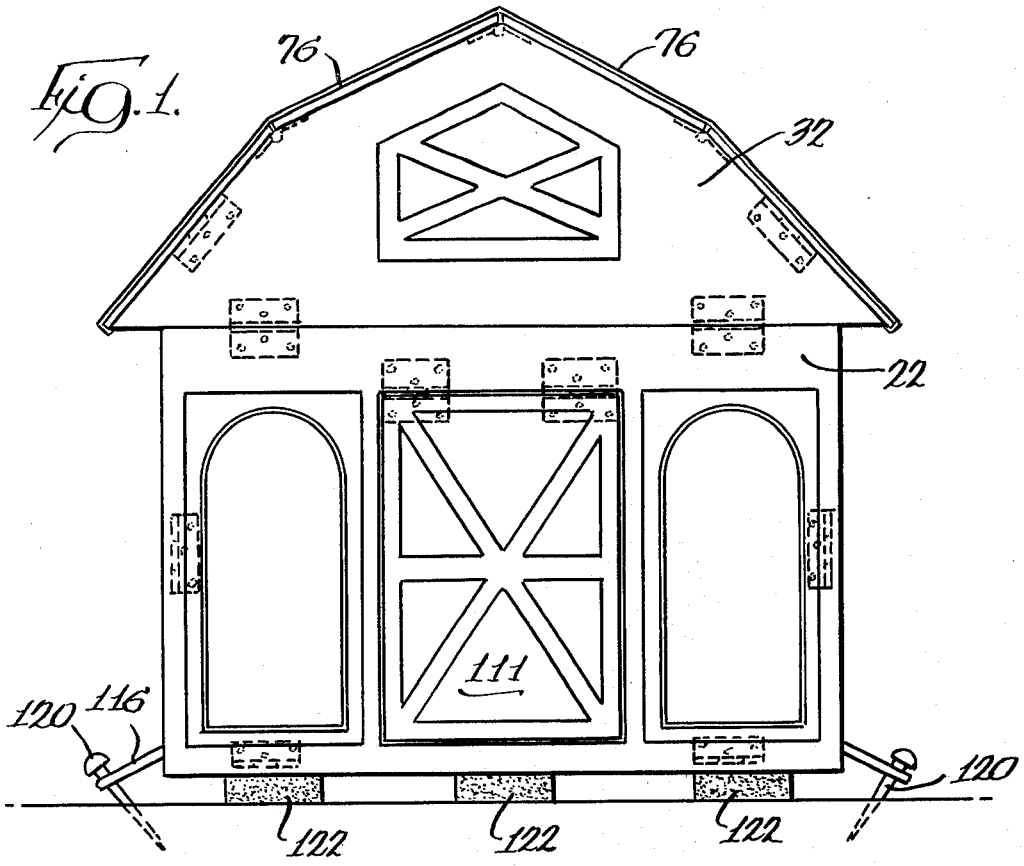
FIG. 1 is a front elevational view of a preferred form of the collapsible dwelling of the present invention.
Figure 2:
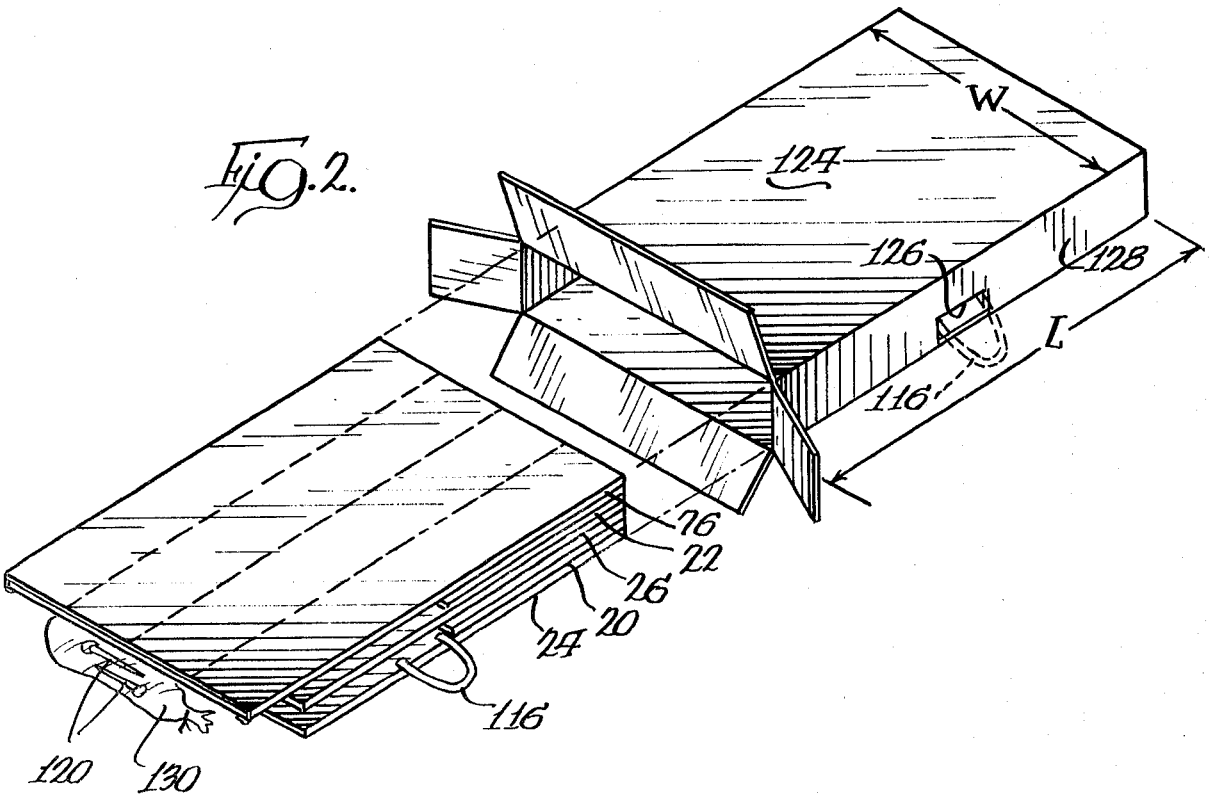
FIG. 2 is a perspective view of the dwelling in a collapsed state in relationship to a package used to contain and carry the dwelling.
Figure 3:
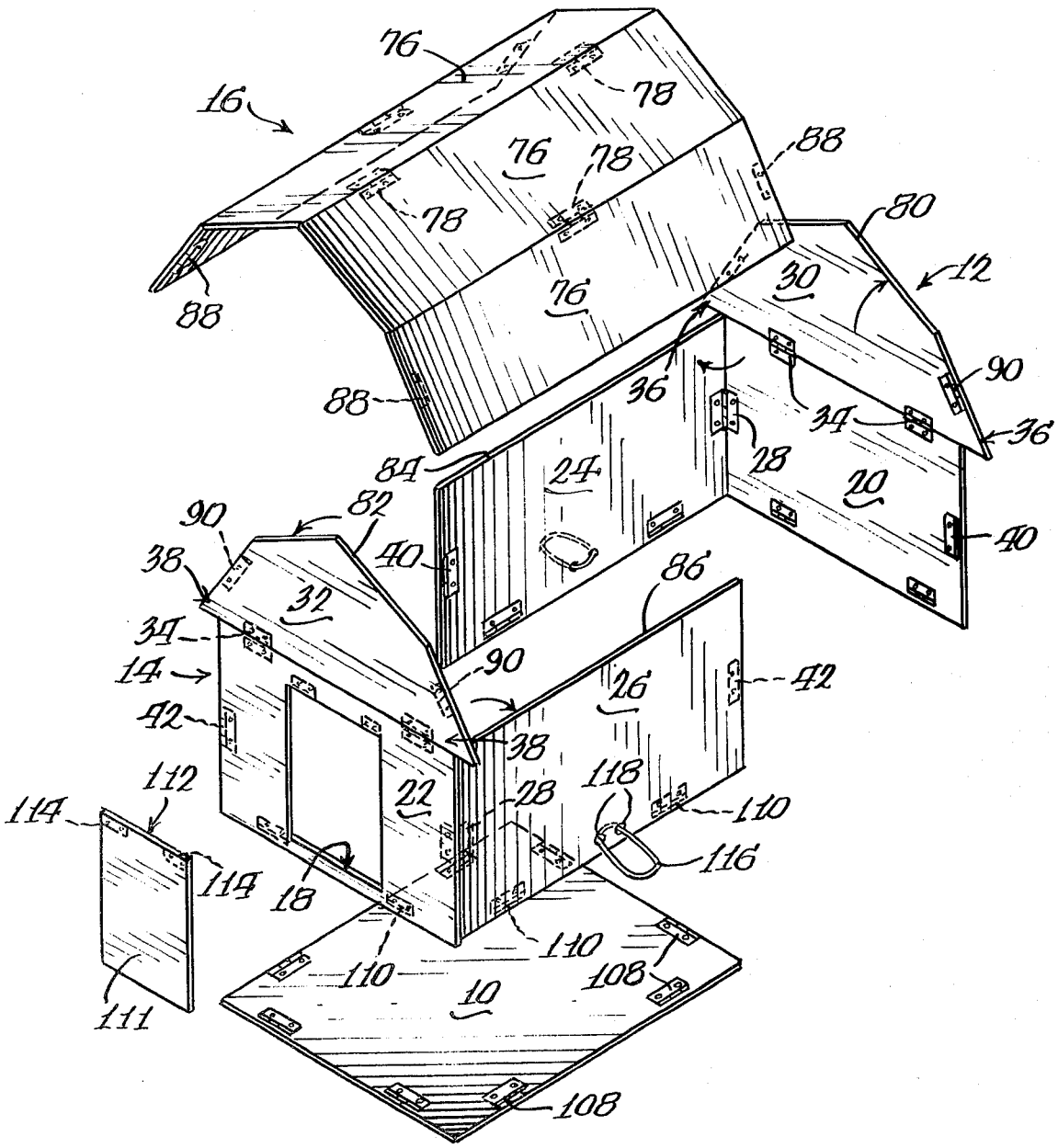
FIG. 3 is an exploded perspective view of the collapsible dwelling of FIGS. 1 and 2.

Referring initially to FIGS. 1–3, a preferred form of the collapsible dwelling is illustrated to include, generally, a rectangular base element 10, first and second foldable wall elements, 12 and 14, respectively, and a roof element 16 positionable atop and securable with the wall elements 12 and 14.

The wall elements 12, 14 are identical with the exception of the inclusion of an access opening 18 in the second element 14, which permits entry into the dwelling. Each wall element includes an endwall 20, 22 hingedly joined with a sidewall 24, 26 for rotation about a substantially vertical axis. A single butt hinge 28 is illustrated at the inside corner where the sidewalls 24, 26 and endwalls 20, 22 meet, and its use is preferred in that the hinges permit the endwalls 20, 22 and sidewalls 24, 26 to be folded closely against each other for compact storage.

A gable 30, 32 is carried by each endwall 20, 22 and is hingedly secured by a pair of butt hinges 34 which permit relative pivoting movement of the endwalls 20,

22 and gables 30, 32 about a substantially horizontal axis. The gables 30, 32 extend laterally beyond the width of the endwalls 20, 22 so as to form overhanging edges 36, 38.

The elements 12, 14 are joined with each other by suitable means to define a continuous wall structure. In a preferred form of the invention, hinge portions 40, 42 are respectively attached to the first and second wall elements 12, 14 and are mated with each other and suitably secured when the elements 12, 14 are in aligned relationship.

Figure 6:
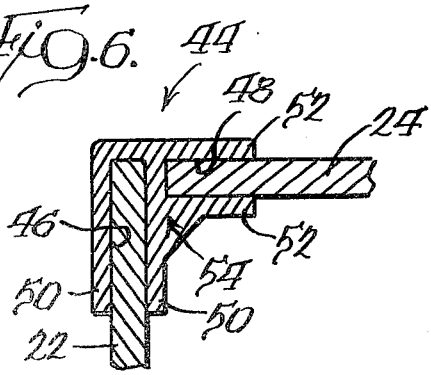
FIG. 6 is a sectional view of a corner joint used to assemble the dwelling.
Figure 7:
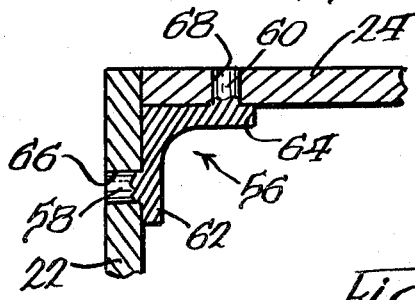
FIG. 7 is a sectional view of an alternate form of corner joint.
Figure 8:
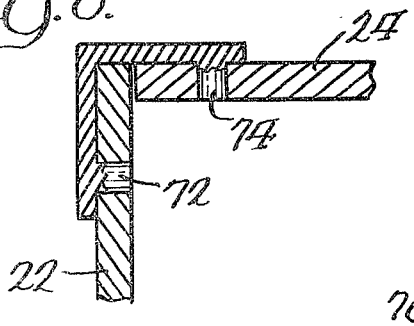
FIG. 8 is a sectional view of an additional form of corner joint.

Alternate means for joining the corners are illustrated in FIGS. 6–8 and are described in relationship with an exemplary corner at the juncture of the sidewall 24 and endwall 22. In FIG. 6, a corner joint 44 is shown having integrally formed channels 46, 48 situated at right angles with respect to each other. The joint 44 is fabricated preferably from a resilient material and has legs 50, 52 defining each channel, which legs 50, 52 flex slightly upon the introduction of the endwall 22 and sidewall 24 and capture and frictionally retain the endwall 22 and sidewall 24, respectively. The joint 44 is reinforced interiorly at 54 to afford additional rigidity at the corner.

In FIG. 7, an alternate corner joint 56 is illustrated. The joint 56 is substantially L-shaped and is designed to fit flushly within the corner formed by the closely abutting endwall 22 and sidewall 24. Pegs 58, 60 project perpendicularly outwardly from the legs 62, 64, respectively, and are received in correspondingly configured bores 66, 68 in the sidewall 24 and endwall 22. The corner join 56 is preferably of a flexible construction so that it will deform sufficiently to seat the pegs 58, 60 within the bores 66, 68.

In FIG. 8, a corner joint 70 is illustrated, and is otherwise similar to that shown in FIG. 7 with the exception that the joint 70 is fit over the exterior of the corner, with the corresponding pegs 72, 74 projecting inwardly, respectively into the endwall 22 and sidewall 24. The corner joints illustrated in FIGS. 7 and 8 are designed to be snap-fit and fixedly maintain the corners.

With the walls 12, 14 joined, each with the other, the roof 16 can be assembled. The roof shown in FIGS. 1 and 3 is formed by four rectangular panels 76, arranged side-to-side, with each panel 76 hingedly joined with the panel 76 immediately there adjacent by a butt hinge 78. The roof 16 is designed to seat closely against the upper edges 80, 82 of the gables 30, 32, respectively. The overhanging edges 36, 38 of the gables 30, 32 maintain the panels 76, at the laterally opposing edges of the roof 16, suspended above the top edges 84, 86 of the sidewalls 24, 26, whereby an air space is formed to provide cross-ventilation inside the dwelling.

With the roof 16 in position, hinge portions 88, secured at the underside of the roof 16, align with corresponding hinge portions 90, adjacent the top of the gables 30, 32 and can be appropriately secured, each with the other, to secure the roof 16. A plastic or resilient rubberlike sheathing (not shown) may be applied over the roof 16 to provide weatherproofing.

Figure 9:
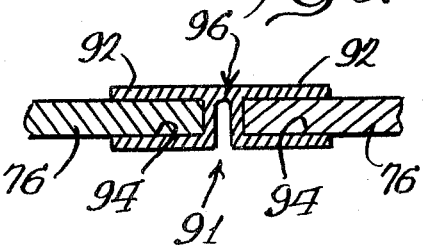
FIG. 9 is a sectional view of a connecting means for adjacent panels used to cooperatively form the roof.
Figure 10:
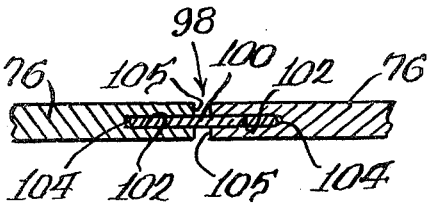
FIG. 10 is a sectional view of an alternate form of connecting means for the roof panels.

In FIGS. 9 and 10 are shown alternative means for assembling the roof panels 76. In FIG. 9 is shown a joining means 91, including a pair of oppositely opening U-shaped channels 9, which surround the edges 94 of adjacent panels 76. The channels 92 frictionally retain the panels 76 and are joined by a resilient web portion 96 which flexes to permit the roof panels 76 to assume the contour of the gable. If the joining means 91 is extended the entire length of the panels, it serves also to deflect moisture away from the panel edges 94 and thereby seal the region between panels.

In FIG. 10, an alternate panel joining means 98 is shown, and comprises a flexible body 100 whose opposing edges fit closely within a pair of longitudinal grooves 102. The grooves 102 are of a depth to contact the edges 104 of the body 100 before the edges 105 of the panels 76 abut, so that non-interfering relative flexing can occur between the panels. The body 100 defines, in conjunction with the edges 105 of the panels 76, a conduit for directing water off the roof 16.

A rectangular base element 10 serves as the floor for the dwelling. The base 10 is shown in FIG. 3 to include eight hinge portions 108 which align with mating portions 110 on the assembled wall elements 12, 14 and to which they are suitably secured.

Fit within the access opening 18 in the endwall 22 is a correspondingly configured door 111. The door 111 is hinged preferably at its upper edge 112 by a pair of hinges 114 having horizontal pivot axes. The door can be pivoted either inwardly or outwardly to facilitate ingress and egress and tends by its own weight to the closed position.

While the above-described arrangement is preferred from the standpoint of assembly and packaging, as will be described in subsequent paragraphs, the invention contemplates any combination of hinges and corner joints as detailed in FIGS. 6–8. For example, the corner joints described in FIGS. 6–8 may substitute for the hinge 28 between the endwalls 20, 22 and sidewalls 24, 26. Further, the specific number of hinges described should not be viewed as limiting.

As an additional convenience to the assembler, the mating hinge portions are irregularly spaced and strategically located so that they align only with the correct mating element. This obviates improper assembly.

Particularly suitable for the present invention are hinge assemblies manufactured by the Burklyn Hinge Division of Hartwell Corp. The H1000 series hinge, and specifically the H1002 hinge, has a spring-loaded connecting pin which is simply operable without the use of tools as would ordinarily be required to locate conventional hinge pins.

To fixedly locate the dwelling upon a supporting surface, a pair of anchoring loops 116 are mounted to the sidewalls 24, 26. Each anchoring loop 116 is extended through a pair of spaced openings 118 in the sidewalls 24, 26. Ground stakes 120 capture the loops and are extended angularly into the supporting surface. So arranged, lateral or vertical shifting of the dwelling is substantially restrained.

A plurality of insulating blocks 122 are disposed between the base 10 and the supporting surface. The blocks 122 are preferably fabricated from a compressible material so that they will deform to accommodate any irregularities in the supporting surface. The blocks 122 serve primarily to insulate the dwelling from any moisture contained by the supporting surface.

To disassemble the dwelling, the roof 16 is removed and the wall elements 12, 14 detached from each other and the supporting base 10. The endwalls 20, 22 and sidewalls 24, 26 are folded toward each other, and the gables 30, 32 folded outwardly over the endwalls 20, 22 as indicated by the arrows in FIG. 3. The base 10, wall elements 12, 14 and roof 16 are stacked, one upon the other, as indicated in FIG. 2, for insertion into an enclosed container 124.

The carton 124 includes a cutout 126 in one of its edges 128, which coincides with the location of the anchoring loop 166 on the stacked sidewalls 24, 26. The loop 116 can be drawn through the cutout 126 and serves conveniently as a carrying handle for the entire package. As can be seen from the drawings, the width (W) and length (L) of the carton are no greater than the dimension of the longest and widest element, which, in this construction is the roof 16. The stakes 120 which are the only loose elements, can be stored in a pouch 130 and included in the carton 124.

Figure 4:
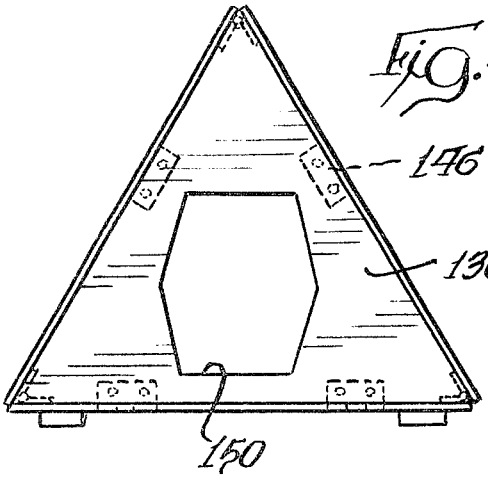
FIG. 4 is a front elevational view of an alternate embodiment of the invention.
Figure 5:
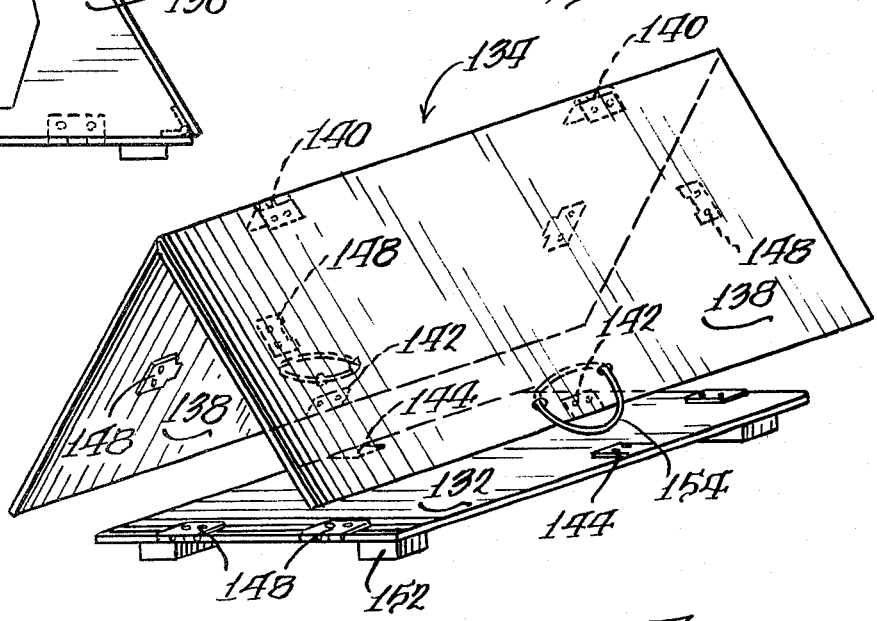
FIG. 5 is an exploded perspective view of the dwelling in FIG. 4.

An alternate embodiment of the invention is shown in FIGS. 4 and 5. The disclosed A-frame construction comprises generally a base 132, roof 134 and endwalls 136 (only front shown). The roof 134 is formed by rectangular panel 138 joined along their length by a pair of butt hinges 140. Each roof panel carries a hinge portion 142 which aligns and mates with hinge portions 144 attached to the base 132. The endwalls 136 are fit in the region between the roof 134 and base 132 with hinge portions 146 on the endwalls 136 securable with engaging hinge portions 148 on the roof 134 and base 132.

The A-frame dwelling in FIGS. 4 and 5 has, comparably to the previously described embodiment, an access opening 150, insulating blocks 152, and anchoring loops 154, all of which function as the corresponding elements in FIGS. 1–3. The roof panel joints described in FIGS. 9 and 10 may substitute for the butt hinges 140. The A-frame dwelling, when collapsed, fits within a carton comparable to that illustrated in FIG. 2. At least one of the loops 154, as before, is located strategically in the roof panel 138 to coincide with the cutout 126 in the carton so that it is functional also as a carrying handle for the package containing the dwelling.

The foregoing description was made for purposes of clarifying the invention, with no unnecessary limitations to be derived therefrom.

We claim:

1. A collapsible dwelling comprising:

first and second foldable wall elements, each said wall element including:

(a) an endwall;

(b) a sidewall having a top edge, height substantially equal to that of the endwall and hingedly joined with the endwall for pivoting movement about a substantially vertical axis; and (c) a gable having a width greater than the width of the endwall and being hingedly secured with the endwall for pivoting movement about a substantially horizontal axis;

a first means for mating said first and second foldable wall elements, each with the other, so as to define a continuous wall structure;

a roof element positionable atop the gables whereby an airspace is formed between the top edge of each of the sidewalls and the underside of the roof element to afford cross-ventilation inside the dwelling; and a second means for mating said roof element with the gables;

said roof and said first and second wall elements, when collapsed, being stackable in such a manner that the entire dwelling occupies a space no greater than the length of the longest element and the width of the widest element so that the dwelling can be retained compactly within a container.

2. The dwelling of claim 1 wherein said first and second means each comprises at least one hinge having separate joinable parts on each of the elements which the means mate, said wall elements and roof element being readily joinable with each other through the hinges to define a rigidly interlocked structure that can be easily disassembled by separating the hinge parts for stacking and placement in the container.

3. The dwelling of claim 1 wherein at least one anchoring loop engages said continuous wall structure, which anchoring loop can be used to fixedly locate the dwelling relative to a surface supporting the dwelling.

4. The dwelling of claim 1 including a base element defining a floor within the dwelling and a plurality of hinges, each including joinable parts on the continuous wall structure and the base for mating the base element with said continuous wall structure.

5. The dwelling of claim 3 including a ground stake which captures the anchoring loop and engages the supporting surface to fix the location of the dwelling.

6. The dwelling of claim 3 in combination with a retaining carton, said carton having a substantially enclosed configuration and a cutout on one edge coinciding with the location of the anchoring loop, with the dwelling situated inside the carton, such that the loop can be drawn through the cutout and serve conveniently as a carrying handle for the carton.

7. The dwelling of claim 4 including at least one resilient, compressible insulating block which is disposed between the base element and the supporting surface, whereby the dwelling is maintained positively in an elevated position and thereby insulated from any moisture contained by the supporting surface.

8. A kit for transporting and constructing a collapsible dwelling, said kit comprising:

front and rear endwalls;

opposing sidewalls;

first means for mating said endwalls and sidewalls so as to define a continuous wall structure;

a roof positionable over said continuous wall structure, a second means for mating said roof with said continuous wall structure;

anchoring means on at least one of the sidewalls for anchoring the continuous wall structure with a supporting surface; and a rectangular carton for retaining said front and rear and opposing sidewalls and roof, when collapsed and stacked, one upon the other, said carton having a cutout which coincides with the location of said anchoring means such that said anchoring means can be extended through said cutout and serve conveniently as a carrying handle.

9. The kit of claim 8 wherein said first means comprises at least one resilient corner joint positionable internally of a corner formed between a mated endwall and sidewall, said corner joint having substantially an L-shape and a plurality of integral, outwardly protruding pegs which are received closely within corresponding bores in the endwall and sidewall such that the corner joint can be snap-fit to rigidly maintain the corner.

10. The kit of claim 8 wherein said first means comprises a resilient member having two integrally formed channels situated at right angles with respect to each other, each said channel capturing and frictionally retaining an edge of either an endwall or sidewall to rigidly maintain a corner defined thereby.

* * * * *